US011688975B2

(12) United States Patent
Truong et al.

(10) Patent No.: US 11,688,975 B2
(45) Date of Patent: Jun. 27, 2023

(54) PLUG CONNECTOR AND CONNECTOR ASSEMBLY

(71) Applicant: JESS-LINK PRODUCTS CO., LTD., New Taipei (TW)

(72) Inventors: Thanh-An Truong, New Taipei (TW); Hsu-Feng Chang, New Taipei (TW)

(73) Assignee: JESS-LINK PRODUCTS CO., LTD., New Taipei (TW)

( * ) Notice: Subject to any disclaimer, the term of this patent is extended or adjusted under 35 U.S.C. 154(b) by 84 days.

(21) Appl. No.: 17/484,821

(22) Filed: Sep. 24, 2021

(65) Prior Publication Data

US 2022/0200202 A1 Jun. 23, 2022

(30) Foreign Application Priority Data

Dec. 23, 2020 (TW) ..... 109145729

(51) Int. Cl.

| | |
|---|---|
| ***H01R 13/62*** | (2006.01) |
| ***H01R 13/627*** | (2006.01) |
| ***H01R 12/71*** | (2011.01) |
| ***H01R 13/516*** | (2006.01) |
| ***H01R 13/405*** | (2006.01) |

(52) U.S. Cl.

CPC ..... *H01R 13/6275* (2013.01); *H01R 12/716* (2013.01); *H01R 13/405* (2013.01); *H01R 13/516* (2013.01)

(58) Field of Classification Search

CPC ..... H01R 13/6275; H01R 12/716; H01R 13/405; H01R 13/516; H01R 12/722; H01R 13/6335; H01R 13/6581; H01R 24/60; H01R 13/629

See application file for complete search history.

(56) References Cited

U.S. PATENT DOCUMENTS

| | | | | |
|---|---|---|---|---|
| 6,234,827 | B1 * | 5/2001 | Nishio | H01R 13/6582 439/357 |
| 6,645,005 | B2 * | 11/2003 | Wu | H01R 12/707 439/74 |
| 8,388,380 | B1 * | 3/2013 | Van der Steen | H01R 13/5202 439/607.36 |
| 2016/0308308 | A1 * | 10/2016 | Masunaga | H01R 13/6275 |

(Continued)

FOREIGN PATENT DOCUMENTS

| | | | |
|---|---|---|---|
| CN | 206789805 | U | 12/2017 |
| CN | 208209042 | U | 12/2018 |
| TW | M615364 | U | 8/2021 |

*Primary Examiner* — Truc T Nguyen

(57) ABSTRACT

The present invention provides a plug connector engaged with a socket. The plug connector includes an insulating body and a metal limiter. The insulating body has a mating port and a space for accommodating a circuit board, and the mating port is connected with the space. The metal limiter includes a metal bottom plate and a pair of metal side structures. The metal bottom plate is arranged under the opening of the mating port. The pair of metal side structures are respectively connected to the two sides of the metal bottom plate and arranged on the left and right sides of the opening to form a limiting space. When the plug connector is matched with the socket, the metal shell of the socket is sheathed with the front end of the insulating body, and the metal shell is located in the limiting space to restrict the plug connector from shaking.

10 Claims, 8 Drawing Sheets

(56) References Cited

U.S. PATENT DOCUMENTS

| | | | | |
|---|---|---|---|---|
| 2017/0279226 | A1* | 9/2017 | Tsai | H01R 13/6581 |
| 2018/0233855 | A1* | 8/2018 | Phillips | H01R 13/6335 |
| 2018/0269607 | A1* | 9/2018 | Wu | H01R 12/79 |
| 2019/0173232 | A1* | 6/2019 | Lu | H01R 13/6594 |
| 2019/0229447 | A1* | 7/2019 | Tsukashima | H01R 13/629 |
| 2020/0161811 | A1* | 5/2020 | Lu | H01R 13/506 |
| 2022/0190513 | A1* | 6/2022 | Henry | H01R 13/6582 |

* cited by examiner

PLUG CONNECTOR AND CONNECTOR ASSEMBLY

BACKGROUND OF THE INVENTION

1. Field of the Invention

The present invention relates to a connector plug and a connector assembly, and more particularly relates to a connector assembly that can prevent the connector plug sharking.

2. Description of the Prior Art

The connector is used to the connecting unit of the electronic signal and the attachment. The signals are converted and transmitted between electronic devices through cables and connectors. In another word, the connector is also a bridge for signals. The connectors are widely used in cars, computer peripherals, communication data, industrial, military aerospace, transportation, consumer electronics, medical, apparatus, commercial equipment, etc. Therefore, connectors play an important role in the variety field.

The electricity connector usually includes a connector plug and a connector socket which is matching the connector plug. The electrical connection among the electronic devices is implemented by the connected between the connector plug and the connector socket. Generally speaking, the connector socket is fixed on the substrate (such as circuit board) firstly, and then the connector plug is connected to the connector socket for electrically connecting the circuit board inside the connector plug with the substrate.

When the electrical connector is applied to the equipment with strongly vibration, the connecting plug may be shaken and separated from the connector socket, which makes equipment malfunction. Moreover, if the dropping connecting plug touches other components and forms a short circuit, the electrical connector may be produced the spark, thereby making risk of fire.

With the technology rapidly develops, the electronic devices are asked for thinner, smaller and more functions. The circuit board, electronic unit, and wire inside the connector are much more precise. The prior art can sleeve the plug and socket together for preventing shaking. However, the thin sleeve shell is easy to crack. On the contrary, the thickened sleeve shell limits the space of miniaturization and utilization of the electronic device.

Therefore, a thinner connector structure is needed to prevent the connector plug separated from the connector socket for increasing security and efficiency of the device.

SUMMARY OF THE INVENTION

Therefore, the present invention provides a plug connector configured to be connected with a socket. The socket comprises a metal shell. The plug connector comprises the insulating body, the circuit board, and a metal limiter. The insulating body comprises an accommodating space and a mating port, the mating port is connected to the accommodating space. The circuit board is disposed in the accommodating space and comprises a terminal disposed in the front end of the circuit board and the mating port. The metal limiter further comprises the metal bottom plate and a pair of metal side structures. The metal bottom plate is disposed below the mating port. The metal side structures comprise a first side structure and a second side structure are respectively connected to two sides of the metal bottom plate and are disposed on the left and right sides of the mating port to form a limiting space in front of the mating port. Wherein, when the plug connector cooperates with the socket, the metal shell is sleeved on the front end of the insulating body. The metal shell is disposed between the metal bottom plate, the first side structure, and the second side structure for restricting the vibration of the plug connector.

Wherein, the bottom side of the metal bottom plate is covered by an insulating layer, and the insulating layer is formed by injection molding.

Wherein, the metal bottom plate and the two metal side structures are integrally formed. Each of the first side structure and the second side structure is a sheet structure having a bending part towards the front.

Wherein, the insulating layer further comprises a pair of side baffles disposed on the left side and the right side of the mating port, and two metal side structures respectively cover one of the side baffles.

The present invention also provides a connector assembly comprising the socket and the plug connector. The socket comprises a metal shell. The plug connector is configured to be connected with the socket. The plug connector further comprises the insulating body, the circuit board, and a metal limiter. The insulating body comprises an accommodating space and a mating port, the mating port has the front opening, and the mating port is connected to the accommodating space. The circuit board is disposed in the accommodating space and comprises a terminal disposed in the front end of the circuit board and the mating port. The metal limiter further comprises the metal bottom plate and a pair of metal side structures. The metal bottom plate is disposed under the mating port. The metal side structures comprise a first side structure and a second side structure are respectively connected to two sides of the metal bottom plate, and the first side structure and the second side structure are disposed on the left and right sides of the mating port to form a limiting space in front of the mating port. Wherein, when the plug connector cooperates with the socket, the metal shell is sleeved on the front end of the insulating body. The metal shell is disposed between the metal bottom plate, the first side structure, and the second side structure for restricting the position of the plug connector.

Wherein, the bottom side of the metal bottom plate is covered by an insulating layer, and the insulating layer is formed by injection molding.

Wherein, the metal bottom plate and the two metal side structures are integrally formed. Each of the first side structure and the second side structure is a sheet structure having a bending part towards the front.

Wherein, the insulating layer further comprises a pair of side baffles disposed on the left side and the right side of the mating port and two metal side structures respectively cover one of the side baffles.

The present invention also provides the plug connector manufacturing method. The plug connector manufacturing method comprises the following step: producing an insulating body, the insulating body comprising an accommodating space and a mating port, the mating port being connected to the accommodating space; producing a metal limiter, the metal limiter comprising a metal bottom plate and a pair of metal side structures, the metal side structures being respectively connected to two sides of the metal bottom plate; injecting an insulating layer on the outward-facing bottom side of the metal bottom plate of the metal limiter; assembling the metal limiter to the insulating body to make the metal side structures to be disposed on the left and right sides of the mating ports to form a limiting space on the mating port.

Wherein, the step of providing a metal limiter further comprises the following steps: providing a metal sheet comprising a middle section and the two sides; symmetry bending the two side sections of the metal sheet to make the two side sections forming the metal side structures, the middle section of the metal sheet forming the metal bottom, and making the metal sheet forming the metal limiter.

Wherein, the shape of the metal sheet being U shape, symmetry bending means bending the two side sections inwardly for 90 degrees and then folding the two side sections outward for 180 degrees.

The manufacturing method of this present invention further comprises the following step: proving a circuit board, the circuit board comprising a terminal; setting up the circuit board in the accommodation space, and the terminal disposed in the mating port.

In summary, the plug connector and connector assembly of this present invention provides a strong structural force in the limited structure thickness because of the metal material limiter for preventing the plug connector from separating from the connector socket by vibration. The elasticity of metals can align the plug of oblique insertion. Therefore, the plug connector and connector assembly can be downsized, the electronic device has more space to use, and the device design can be more flexible. The integrally formed limiter can bear the force of multiple vectors and counteract each other. The metal bottom plate is covered with a thin insulating layer to make the bottom side of the connector assembly face down and attach to the main circuit board, so that the connector assembly won't cause short circuit or electromagnetic interference with the main circuit board. The sheet with bending and reverse structure makes the metal limiter maintain the toughness. The side baffles protruding from the insulating body can strengthen the structural stability and make firmly binding between the insulating body and limiter.

BRIEF DESCRIPTION OF THE APPENDED DRAWINGS

DETAILED DESCRIPTION OF THE INVENTION

For the sake of the advantages, spirits and features of the present invention can be understood more easily and clearly, the detailed descriptions and discussions will be made later by way of the embodiments and with reference of the diagrams. It is worth noting that these embodiments are merely representative embodiments of the present invention, wherein the specific methods, devices, conditions, materials and the like are not limited to the embodiments of the present invention or corresponding embodiments. Moreover, the devices in the figures are only used to express their corresponding positions and are not drawing according to their actual proportion.

Figure 1A:
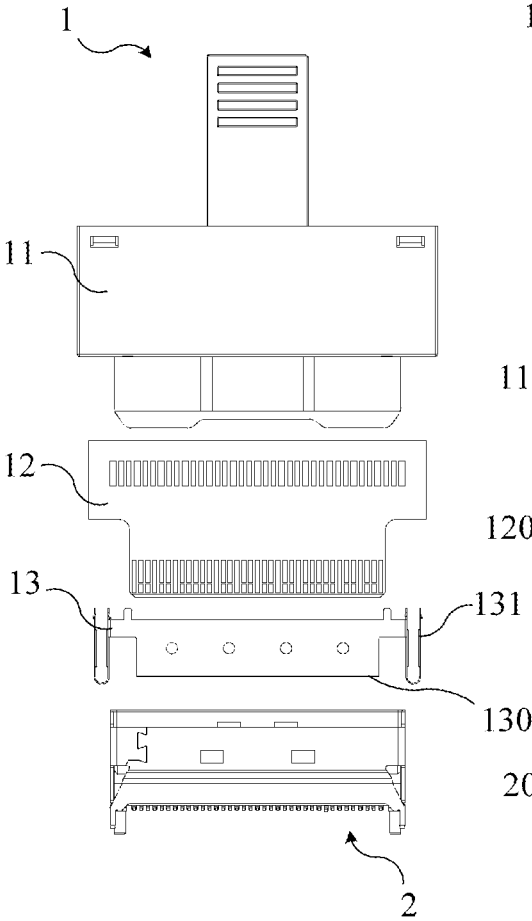
FIG. 1A is an exploded view diagram illustrating the connector assembly according to an embodiment of the present invention.
Figure 1B:
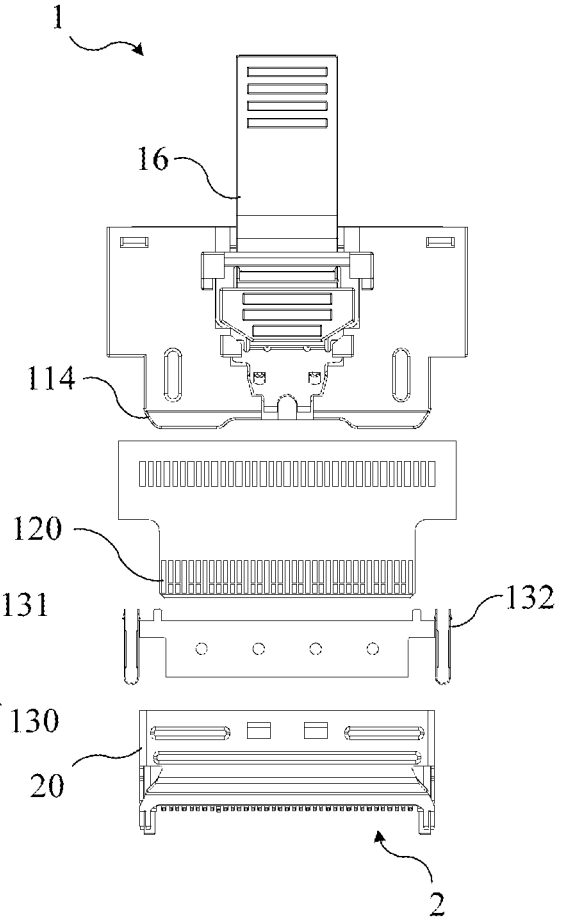
FIG. 1B is another exploded view diagram illustrating the connector assembly according to an embodiment in FIG. 1A.
Figure 4A:
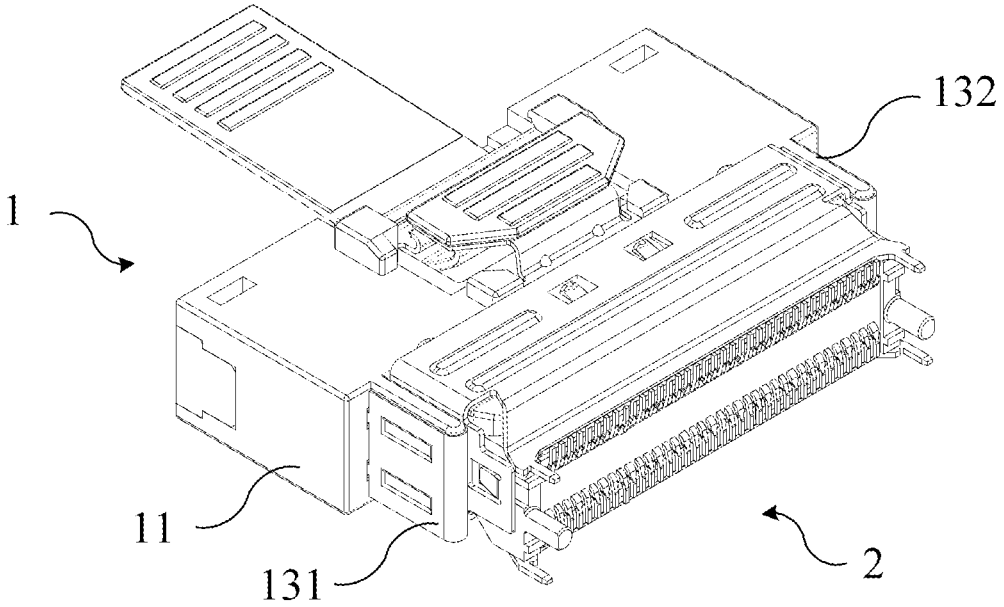
FIG. 4A is an oblique diagram illustrating the connector assembly after joined according to an embodiment in FIG. 1A.
Figure 4B:
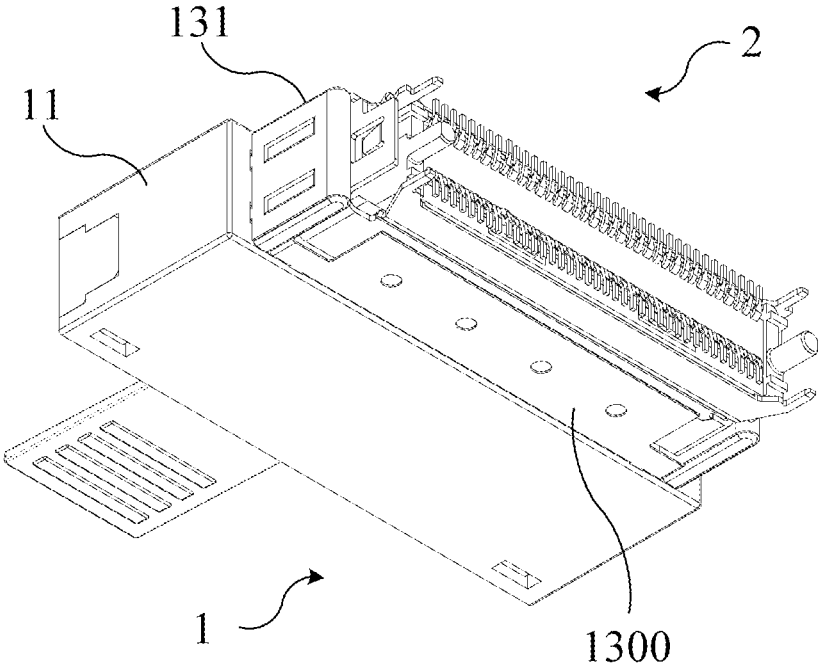
FIG. 4B is another oblique diagram illustrating the connector assembly after joined according to an embodiment in FIG. 4A.

Please refer to FIG. 1A to FIG. 4B. FIG. 1A and FIG. 1B are the bottom and the top exploded view diagram illustrating the connector assembly according to an embodiment of the present invention. FIG. 2A and FIG. 2B are the oblique diagram illustrating the metal limiter according to an embodiment. FIG. 4A and FIG. 4B are the oblique diagram illustrating the connector assembly after joined according to an embodiment.

In this embodiment, a connector assembly includes a plug connector 1 configured to connect with a socket 2. The Socket 2 has a metal shell 20. The plug connector 1 includes a insulating body 11, a circuit board 12, and a metal limiter 13. The insulating body 11 comprises an accommodating space 110 and a mating port 114; the mating port 114 is connected to the accommodating space 110. The circuit board 12 is configured in the accommodating space 110 and comprises a terminal 120 configured at the front end of the circuit board 12. The metal limiter 13 further includes the metal bottom plate 130 and a pair of metal side structures. The metal bottom plate 130 is configured below the mating port. The metal side structures comprise a first side structure 131 and a second side structure 132 respectively connected to two sides of the metal bottom plate 130, and the first side structure 131 and the second side structure 132 are configured on the left and right sides of the mating port 114, to form a limiting space 15 forward the mating port 114. Wherein, when the plug connector 1 cooperates with the socket 2, the metal shell 20 is sleeved on the front end of the insulating body 11. The metal shell 20 is disposed among the metal bottom plate 130, the first side structure 131, and the second side structure 132 for restricting the position of the plug connector 1.

The word "forward" mentioned previously means the connecting direction which plug connector 1 towards the socket 2. The mating port 114 means the side that plug connector 1 first contacts to the socket 2. The side of the up, down, right, and left are the relative direction of the plug connector 1.

The connector assembly is the MCIO connector basically. The connector assembly is applied in electronic device and considered as a signal transmit interface between the unit and the main-board, the unit and the unit, and between different electronic devices.

When the connector plug 1 cooperates with the socket 2, the terminal 120 is inserted in the slot of the socket 2. The metal shell 20 is sleeved outside the front end of the insulating body 11, but the sidewall and the bottom wall of the metal shell 20 are disposed inside the limiting space 15. In another word, the metal shell 20 is set among the metal bottom plate 130, the first side structure 131, and the second side structure 132. Therefore, separation of connector plug 1 can be preventing and the safety is improved.

The first side structure 131 and second side structure 132 limit the amplitude of the shaking of the plug connector 1 in horizontal direction (left and right), the metal bottom plate 130 limits the amplitude of the shaking of the plug connector 1 in vertical direction (up and down). Because of the toughness of the metal limiter 13, the metal bottom plate 130 can be thinner than the plastic plate of prior art, but the certain structural strength is still enough and aligns the plug of oblique insertion. Therefore, the volume of the plug connector 1 can be downsized and operated in a small space. Furthermore, when the metal bottom plate 130 contacts the metal shell 20 of the socket 2 directly or couples to the other metal unit indirectly, the conductivity continuity of both can form the electromagnetic interference shield for reducing electromagnetic interference to the terminal 120 from the external environment.

A buckle device 16 is disposed on the upper part of the plug connector 1. The buckle device 16 comprises a pulling part 162 and a fastener 164. The fastener 164 is an elastic sheet with the protruding bulge and disposed on the insulating body 11. When the plug connector 1 cooperates with the socket 2, the fastener 164 of the buckle device 16 can be matched with a hole of the metal shell 20 to fix the plug connector 1 and the socket 2. The fastener 164 connects with the pulling part 162. When the plug connector 1 is removing from the socket 2, pull the pulling part 162 to make the fastener 164 separate from the hole of the metal shell 20 for lift restrictions. The buckle device 16 limits the amplitude of the pulling upward of the plug connector 1 for preventing the plug connector 1 divorcing backward from the connector socket 2.

Figure 2A:
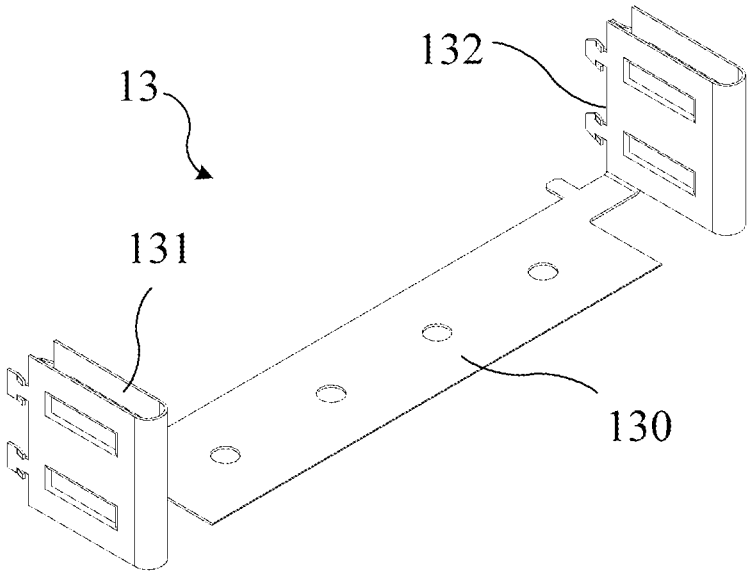
FIG. 2A is an oblique diagram illustrating the metal limiter according to an embodiment in FIG. 1A.
Figure 2B:
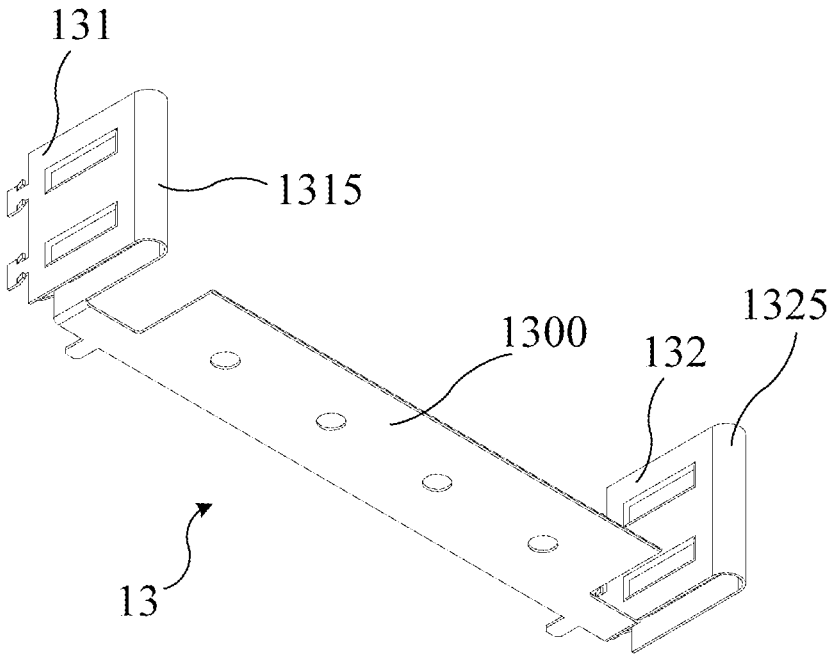
FIG. 2B is another oblique diagram illustrating the metal limiter according to an embodiment in FIG. 2A.
Figure 3:
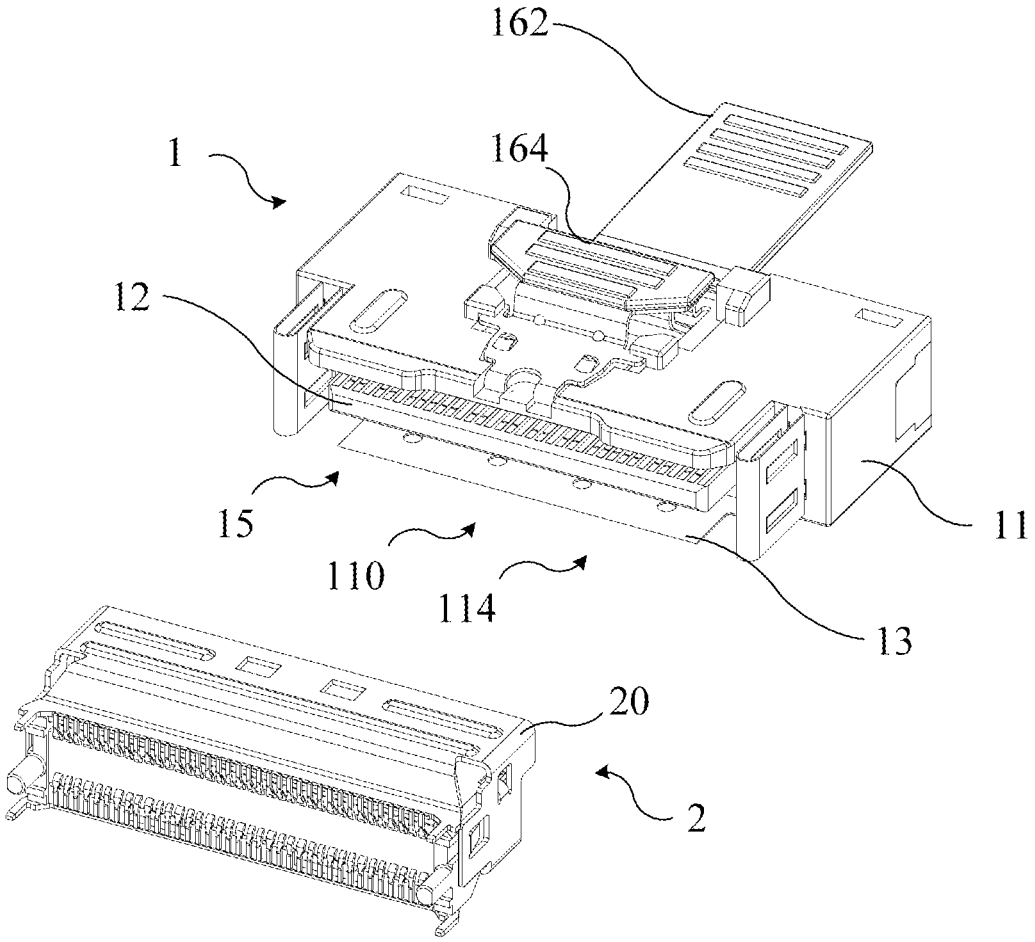
FIG. 3 is an oblique diagram illustrating the connector assembly according to an embodiment in FIG. 1A.

As shown in FIG. 2A and FIG. 2B, the metal bottom plate 130 and two metal side structures are integrally formed. The integrally formed metal limiter 13 is easier processed and can transmit force stably for dispersion the force in different directions. The metal bottom plate 130, the first side structure 131, and the second side structure 132 have the mortise for tenoning on the insulating body 11 respectively.

As shown in FIG. 2A and FIG. 2B, the first side structure 131 and the second side structure 132 is a sheet structure that has the bending part towards the front respectively. The first side structure bending section 1315 and the second side structure bending section 1325 absorbs horizontal force, and provides the holding elasticity.

FIG. 2B and FIG. 4B show that the bottom side of the metal bottom plate 130 is covered by an insulating layer 1300, and the insulating layer 1300 is formed by injection molding. The insulating layer 1300 can be the plastic or the ceramics by injection molding to make the plastic or the ceramics thinly attached on the metal bottom plate 130. The insulating layer 1300 makes the metal bottom plate 130 be insulation, that also means the outside of the lower part of the plug connector 1 could be insulated. The outside insulation of plug connector 1 prevents the sort circuit caused by plug connector 1 contacted to the other metal components. The inside of the metal bottom plate 130 may selectively lay the insulating layer.

Figure 5A:
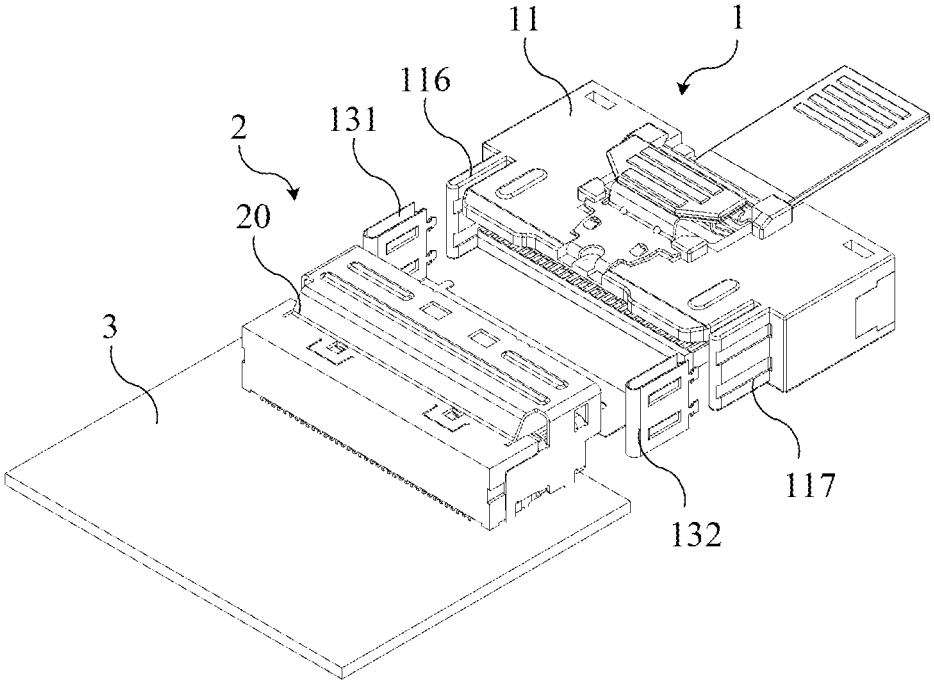
FIG. 5A is an oblique explode diagram illustrating the connector assembly after joined according to another embodiment.
Figure 5B:
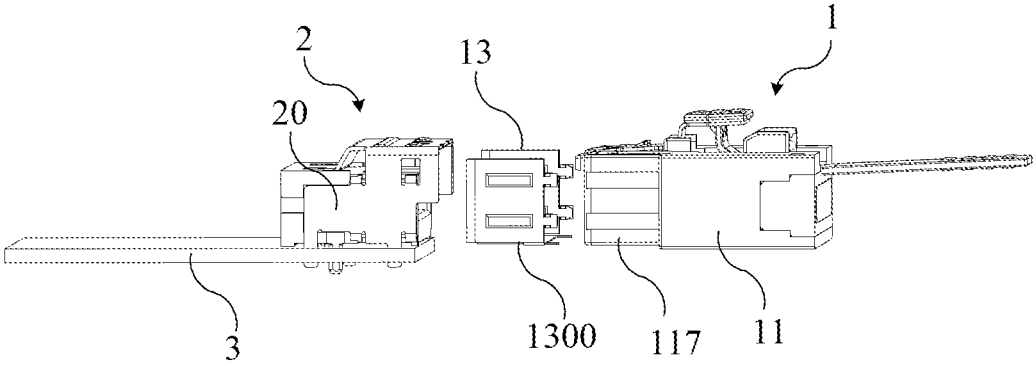
FIG. 5B is a side view explode diagram illustrating the connector assembly according to an embodiment in FIG. 5A.
Figure 6:
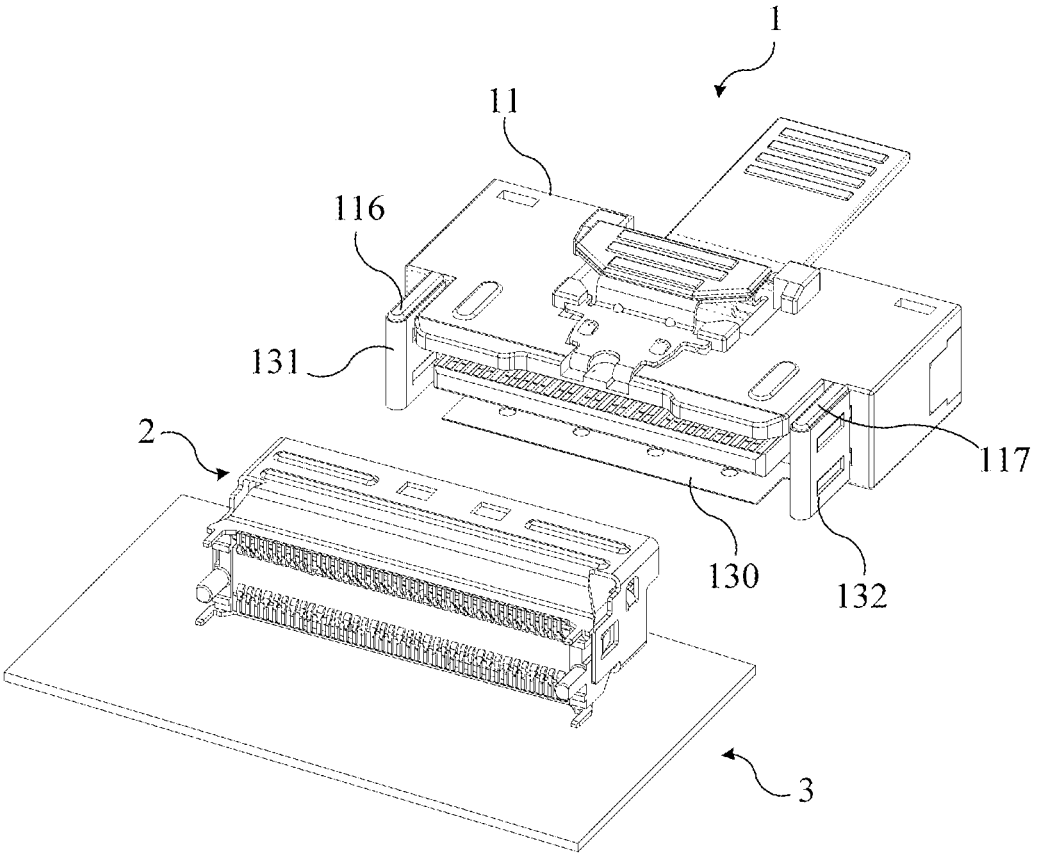
FIG. 6 is an oblique diagram illustrating the connector assembly according to another embodiment.

Please refer to FIG. 5A, FIG. 5B, and FIG. 6. FIG. 5A and FIG. 5B is the oblique explode diagram illustrating the connector assembly according to another embodiment. FIG. 6 is an oblique diagram illustrating the connector assembly according to another embodiment. The structural elements described in the previous embodiment but not described in this embodiment can be combined with this embodiment under reasonable design.

This embodiment illustrates the connected method of the connector assembly when the socket 2 sets in a main circuit board 3 and the slot direction of socket 2 is parallel to the main circuit board 3. When the slot direction is parallel to the main circuit board 3, there is a slight height gap between the metal shell 20 and the main circuit board 3, which is not enough to insert deeply for the general plastic shell. The plug connector 1 is only allowed to connect with socket 2 from the structure of the left, right, and upper parts of the metal shell 20 in the prior art. Therefore, the metal bottom plate 130 of the present invention is allowed to insert deeply into the gap and maintain structural strength. Furthermore, the bottom side of the metal bottom plate 130 contacts the main circuit board 3, so the insulating layer 1300 by injection molding avoids the electromagnetic interference between the metal bottom plate 130 and the main circuit board 3.

The insulating body 11 further comprises a pair of side baffles. The pair of side baffles is respectively as the first side baffle 116 and the second side baffle 117, and they are disposed on the right and left side of the mating ports 114 also extended forward. Two bending metal side structure respectively covers one of the side baffle, which is the first side structure 131 covers the first side baffle 116 and the second side structure 132 covers the second side baffle 117. The side baffle can be the plastic material for providing the larger structural stable and the matrix can be firmly attached by the first side structure 131 and the second side structure 132. Moreover, the first side structure 131 and first side baffle 116 have the corresponding depression structure, hollowing structure or protrusion structure to assembled stable; the second side structure 132 and second side baffle 117 are the same. When the plug connector 1 assembling the first side structure 131 and first side baffle 116 is connected with the socket 2, the flexibility of the first side structure 131 and stability of the first side baffle 116 is remained. Thereby, the connecting can be more stable and absorb the vibration. The first side structure 131 and the metal bottom plate 130 of integrally formed also become tougher.

Figure 7:
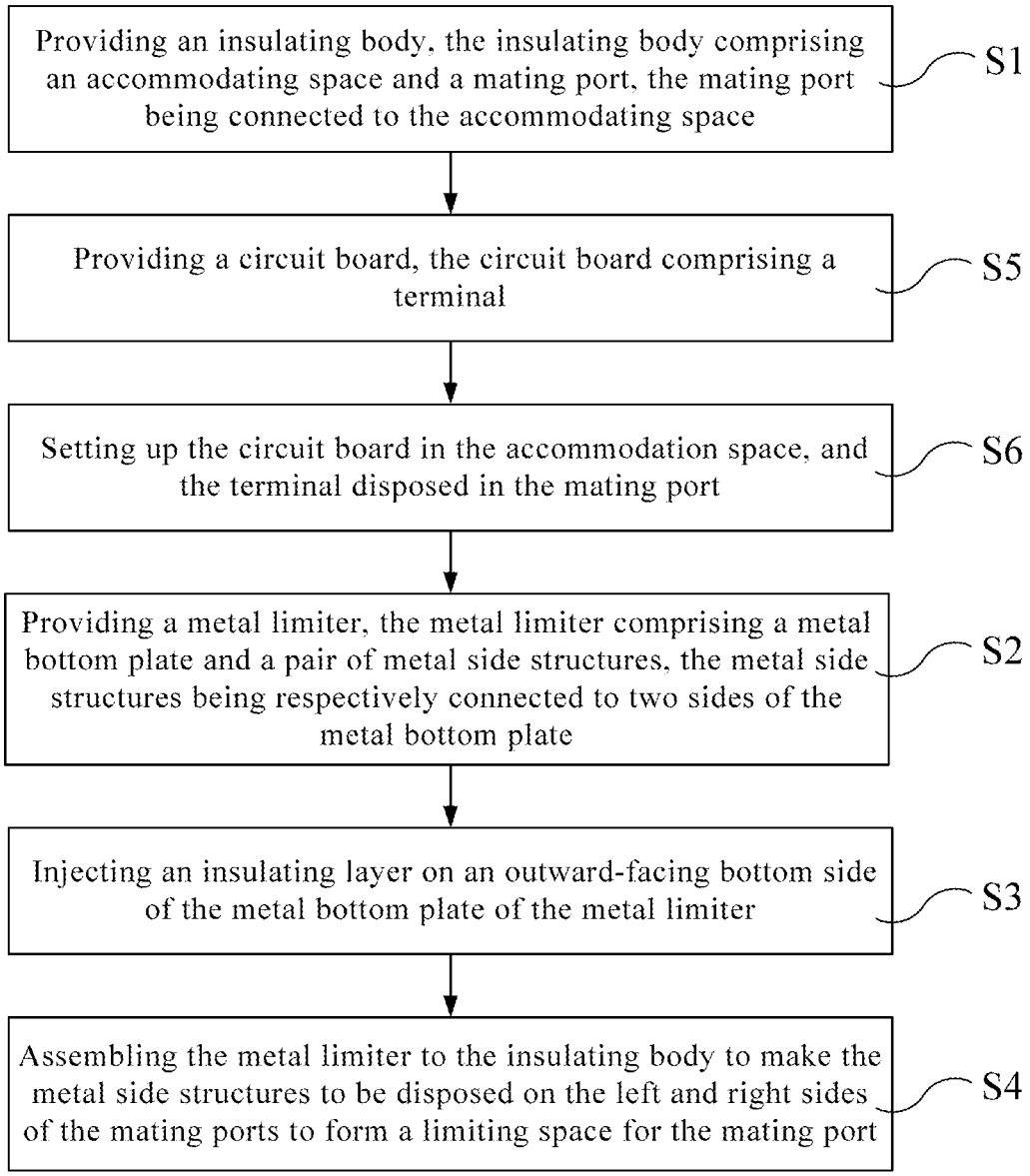
FIG. 7 is a method flow chart of the manufacturing connector assembly according to another embodiment.

Please refer to FIG. 7. FIG. 7 is a method flow chart of the manufacturing connector assembly according to another embodiment. The present invention also provides the manufacturing method of the plug connector. The manufacturing method comprises the following step: S1: providing an insulating body, the insulating body comprising an accommodating space and a mating port, the mating port being connected to the accommodating space; S2: providing a metal limiter, the metal limiter comprising a metal bottom plate and a pair of metal side structures, the metal side structures being respectively connected to two sides of the metal bottom plate; S3: injecting an insulating layer on an outward-facing bottom side of the metal bottom plate of the metal limiter; S4: assembling the metal limiter to the insulating body to make the metal side structures to be disposed on the left and right sides of the mating ports to form a limiting space for the mating port.

The step S2 of providing a metal limiter further includes: S21: providing a metal sheet, the shape of the metal sheet being an U shape comprising a middle section and the two side sections extending from the middle section in a direction perpendicular to the middle section; S22: bending the two side sections of the metal sheet to make the two side sections forming the pair of metal side structures, the middle section of the metal sheet forming the metal bottom, so as to make the metal sheet forming the metal limiter.

The step S22 of bending the two side sections of the metal sheet further comprises: S221: bending the metal sheet along the junctions of the two side sections with the middle section inwardly for 90 degrees; S222: folding the two side sections along the long sides of the two side sections outward for 180 degrees to form the metal side structures, the middle section of the metal sheet forming the metal bottom plate, to make the metal sheet forming the metal limiter.

Figure 8:
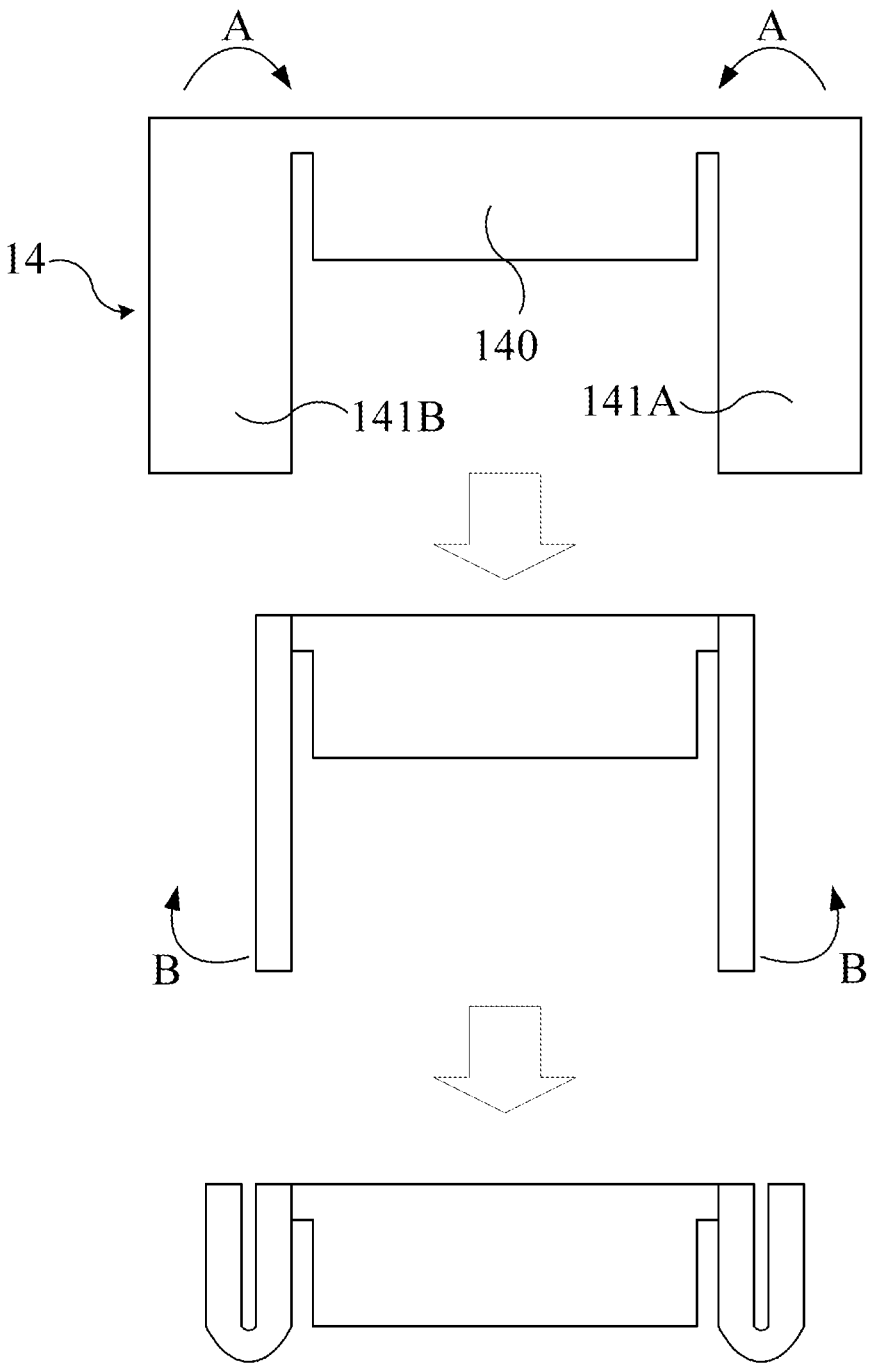
FIG. 8 is a processing schematic diagram illustrating bending the metal sheet according to an embodiment in FIG. 7.

Please refer to FIG. 7 and FIG. 8. FIG. 8 is a processing schematic diagram illustrating bending the metal sheet according to an embodiment in FIG. 7. The metal sheet 14 is U shape. The symmetrical bending means bending two sides sections 141 inwardly (along the A arrow of bending direction) for roughly 90 degrees until vertical middle section 140 and then folding the two side sections 141 outward (along the B arrow of bending direction) for roughly 180 degrees.

In another embodiment (not shown in the figure), the step S22 of bending the two side sections of the metal sheet further comprises: S223: folding the two side sections along the long sides of the two side sections outward for 180 degrees; S224: bending the metal sheet along the junctions of the two side sections with the middle section inwardly for 90 degrees to form the metal side structures, the middle section of the metal sheet forms the metal bottom plate, and the metal sheet forms the metal limiter.

The manufacturing method in the present invention further comprises the following step: S5: providing a circuit board, the circuit board comprising a terminal; S6: setting up the circuit board in the accommodation space, and the terminal disposed in the mating port.

In summary, the plug connector and connector assembly of this present invention provides a strong structural force in the limited structure thickness because of the metal material limiter for preventing the plug connector from separating from the connector socket by vibration. The elasticity of metals can align the plug of oblique insertion. Therefore, the plug connector and connector assembly can be downsized, the electronic device has more space to use, and the device design can be more flexible. In addition to the direction of plugging and unplugging, the plug connector and the socket restrict each other's movement of another five degrees of freedom. The limiter of integrally formed can bear the force of multiple vectors and counteract each other. The metal bottom plate is covered with a thin insulating layer to make the bottom side of the connector assembly face down and attach to the main circuit board, so that the connector assembly won't cause short circuit or electromagnetic interference with the main circuit board. The sheet with bending and reverse structure makes the metal limiter maintain the toughness. The side baffles protruding from the insulating body can strengthen the structural stability and make firmly binding between the insulating body and limiter.

With the examples and explanations mentioned above, the features and spirits of the invention are hopefully well described. More importantly, the present invention is not limited to the embodiment described herein. Those skilled in the art will readily observe that numerous modifications and alterations of the device may be made while retaining the teachings of the invention. Accordingly, the above disclosure should be construed as limited only by the metes and bounds of the appended claims.

What is claimed is:

1. A plug connector, configured to be connected with a socket, the socket comprising a metal shell, the plug connector comprising:

an insulating body, comprising an accommodating space and a mating port, the mating port being connected to the accommodating space;

a circuit board, disposed in the accommodating space and comprising a terminal disposed in the mating port; and a metal limiter, further comprising:

a metal bottom plate, disposed under the mating port; and a pair of metal side structures, comprising a first side structure and a second side structure respectively connected to two sides of the metal bottom plate and disposed on the left and right sides of the mating port, to form a limiting space for the mating port;

wherein, when the plug connector cooperates with the socket, the metal shell is sleeved on a front end of the insulating body, and the metal shell is disposed between the metal bottom plate, the first side structure, and the second side structure for restricting the position of the plug connector.

2. The plug connector of claim 1, wherein the metal bottom plate and the pair of the metal side structures are integrally formed.

3. The plug connector of claim 1, wherein the bottom side of the metal bottom plate is covered by an insulating layer, and the insulating layer is formed by injection molding.

4. The plug connector of claim 1, wherein each of the first side structure and the second side structure is a sheet structure having a bending part towards the front.

5. The plug connector of claim 4, wherein the insulating layer further comprises a pair of side baffles disposed on the two sides of the mating port, and the pairs of metal side structures respectively cover the pair of the side baffles.

6. The plug connector of claim 1, wherein a conductive continuity exists between the metal shell and the metal limiter to form an electromagnetic shielding for the terminal.

7. A plug connector manufacturing method, comprising the following steps:

providing an insulating body, the insulating body comprising an accommodating space and a mating port, the mating port being connected to the accommodating space;

providing a metal limiter, the metal limiter comprising a metal bottom plate and a pair of metal side structures, the pair of metal side structures being respectively connected to two sides of the metal bottom plate;

injecting an insulating layer on an outward facing bottom side of the metal bottom plate of the metal limiter; and assembling the metal limiter to the insulating body to make the pair of metal side structures to be disposed on the left and right sides of the mating ports to form a limiting space for the mating port.

8. The manufacturing method of claim 7, wherein the step of providing the metal limiter further comprises the following steps:

providing a metal sheet, the shape of the metal sheet being an U shape comprising a middle section and the two side sections extending from the middle section in a direction perpendicular to the middle section; and bending the two side sections of the metal sheet to make the two side sections forming the pair of metal side structures, the middle section of the metal sheet forming the metal bottom, so as to make the metal sheet forming the metal limiter.

9. The manufacturing method of claim 8, wherein the step of bending the two side sections of the metal sheet further comprises the following steps:

bending the metal sheet along the junctions of the two side sections with the middle section inwardly for 90 degrees;

folding the two side sections along the long sides of the two side sections outward for 180 degrees to form the pair of metal side structures, the middle section of the metal sheet forming the metal bottom plate, so as to make the metal sheet forming the metal limiter.

10. The manufacturing method of claim 7, further comprising the following steps:

proving a circuit board, the circuit board comprising a terminal; and setting up the circuit board in the accommodation space, and the terminal being disposed in the mating port.

* * * * *